US005101636A

United States Patent [19]

Lee et al.

[11] Patent Number: 5,101,636

[45] Date of Patent: Apr. 7, 1992

[54] CRYOGEN DELIVERY APPARATUS AND METHOD FOR REGULATING THE COOLING POTENTIAL OF A FLOWING CRYOGEN

[75] Inventors: Ron C. Lee, Bloomsbury; Mark J. Kirschner, Morristown, both of N.J.

[73] Assignee: The BOC Group, Inc., New Providence, N.J.

[21] Appl. No.: 633,903

[22] Filed: Dec. 26, 1990

Related U.S. Application Data

[63] Continuation-in-part of Ser. No. 496,397, Mar. 20, 1990, Pat. No. 5,018,358.

[51] Int. Cl.[5] ..... F17C 7/04

[52] U.S. Cl. ..... 62/48.1; 62/49.2; 62/50.1; 62/50.5

[58] Field of Search ..... 62/48.1, 49.2, 50.1, 62/50.5

[56] References Cited

U.S. PATENT DOCUMENTS

| | | | |
|---|---|---|---|
| 4,592,205 | 6/1986 | Brodbeck | 62/50.1 |
| 4,607,489 | 8/1986 | Knongold | 62/49.2 |
| 4,873,832 | 10/1989 | Porter | 62/49.2 |

*Primary Examiner*—Ronald C. Capossela

*Attorney, Agent, or Firm*—Robert I. Pearlman; David M. Rosenblum

[57] ABSTRACT

The present invention relates to a cryogen delivery apparatus and method for delivering a flowing cryogen with a regulated cooling potential. The apparatus includes a pressure vessel for receiving a liquid form of the cryogen. A liquid-vapor interface is maintained within the pressure vessel so that a gaseous form of the cryogen having a low cooling potential is situated above the liquid-vapor interface and a liquid form of the cryogen having a high cooling potential is situated below the liquid-vapor interface. An outlet conduit is provided for delivering the gas and liquid forms of the cryogen from the pressure vessel. The conduit has a moveable end section located within the pressure vessel. When the moveable end section is oscillated above and below the level of a liquid-vapor interface, a two-phase flow of cryogen is delivered comprising the pure gaseous and liquid forms of the cryogen. A timing control circuit is provided to selectively regulate the time intervals that moveable end section is above and below the liquid-vapor interface during each period of oscillation. Such regulation in turn regulates the proportions of the gaseous and liquid forms and thus, the cooling potential contained in the delivered cryogen.

9 Claims, 2 Drawing Sheets

CRYOGEN DELIVERY APPARATUS AND METHOD FOR REGULATING THE COOLING POTENTIAL OF A FLOWING CRYOGEN

RELATED APPLICATIONS

This is a continuation-in-part of application, Ser. No. 07/496,397, filed Mar. 20, 1990 now U.S. Pat. No. 5,018,358.

BACKGROUND OF THE INVENTION

The present invention relates to a cryogen delivery apparatus and method for regulating the cooling potential of a flowing cryogen. More particularly the present invention relates to a cryogen delivery apparatus and method in which the flowing cryogen is delivered as a two phase flow containing gaseous and liquid forms of the cryogen and the cooling potential of the flowing cryogen is regulated by regulating proportions of the gaseous and liquid forms of the cryogen contained within the two phase flow The gaseous and liquid forms of nitrogen are utilized in the blow molding of plastic articles. In blow molding, a cylinder of semi-molten plastic, called a parison, is extruded so that it descends by gravity into position between a pair of opposed mold sections. In one type blow molding process, gaseous nitrogen is released into the parison through a blowing pin until the plastic fits the mold. The gaseous nitrogen is produced by allowing liquid nitrogen from a liquid supply tank to absorb heat in a pipe line leading to the blowing pin.

During the blowing cycle, the injection system gradually cools until liquid nitrogen enters the mold in a fine atomized spray to cool the molded article. In another type of blow molding process air is released into the parison until the plastic fits the mold. Thereafter, liquid nitrogen is injected through the blowing pin to cool the molded article. After the mold is cooled, the mold sections are spread apart for removal of the molded plastic article.

In other cryogenic applications, it is necessary to only deliver measured amounts of a liquid cryogen. For instance, measured amounts of liquid nitrogen are delivered to food containers for producing an inerting atmosphere. In another application, measured amounts of liquid nitrogen are delivered to food containers so that when sealed, the interior of the container is pressurized as the liquid nitrogen boils off within the container. Such pressurization enables the container to maintain its structural integrity.

In all of the above-described applications, which it should be pointed out are described in relation to nitrogen for exemplary purposes only, it is necessary to repeatedly deliver exact amounts of pure liquid and/or gaseous forms of nitrogen. In case of delivery of measured amounts of a liquid cryogen, such as liquid nitrogen in the food process industry, the liquid cryogen is metered by valves, which in the cryogenic environment tend to wear out rather rapidly. Moreover, in the injection blow molding art, the temperature of the liquid nitrogen in the storage tank varies after each filling of storage tank and therefore, the quality of liquid nitrogen that is delivered is also variable.

The present invention solves these problems by providing an apparatus that can repeatedly and intermittently deliver measured amounts of a cryogen in either a liquid and/or a gaseous form, and which does not utilize conventional valves for the metering of the liquid form of the cryogen.

A further problem exists in controlling or metering the exact amount of cooling potential supplied by a cryogen. For instance, in the blow molding art, too much liquid nitrogen may be supplied. In such case, the liquid nitrogen pools in the plastic article and is thus, wasted. Moreover, such pooling also produces uneven cooling of the molded article which can result in discoloration and unacceptable deformities in the finished molded article.

The present invention solves this latter problem by providing an apparatus and method in which a flowing cryogen is delivered with a regulated cooling potential. The regulation of the cooling potential allows the cryogen usage in a particular cryogenic cooling application to be optimized so that the cryogen is not wasted.

SUMMARY OF THE INVENTION

The present invention relates to a cryogen delivery apparatus for regulating the cooling potential of a flowing cryogen. The cryogen delivery apparatus comprises a pressure vessel having an inlet for receiving the flowing cryogen within the pressure vessel. Means are provided for maintaining the flowing cryogen within the pressure vessel so that a liquid-vapor interface is produced within the pressure vessel with a gaseous form of the flowing cryogen having a low cooling potential situated above the liquid-vapor interface and a liquid form of the flowing cryogen having a high cooling potential situated below the liquid vapor-interface. Conduit means for delivering the flowing cryogen from the pressure vessel as a two phase flow functions along with actuable movement means and a controller for regulating the cooling potential of the flowing cryogen delivered from the pressure vessel.

The conduit means extend into the pressure vessel and has a moveable selection adapted to move above and below the liquid-vapor interface to form a first mass flow rate of the gaseous form of the flowing cryogen and a second mass flow rate of the liquid form of the flowing cryogen. The actuable movement means is provided for moving the moveable section above and below the liquid-vapor interface in an oscillating motion for combining the first and second mass flow rates within the conduit means and thereby forming the two phase flow. The oscillating motion has a period comprising a sum of first and second time intervals in which the moveable section is above and below the liquid-vapor interface, respectively, and the two phase flow contains the gaseous and liquid forms of the flowing cryogen in average amounts proportional to the first and second time intervals. The controller has registration means for registering at least one set of the first and second time intervals and actuation means responsive to the registration means for actuating the actuable movement means to move the moveable section in the oscillating motion and at the period. Increasing the first time interval increases the average amount of the gaseous form of the flowing cryogen contained in the two phase flow and alternately, increasing the second time interval increases the average amount of the liquid form of the flowing cryogen contained in the two phase flow. The foregoing alternate decrease and increase of the gaseous and liquid forms of the cryogen within the two phase flow regulates the cooling potential of the flowing cryogen as delivered.

The present invention also provides a method for delivering a flowing cryogen with a regulated cooling potential. In accordance with such method, the flowing cryogen is separated into liquid and gaseous phases containing a gaseous form of the flowing cryogen having a low cooling potential and a liquid form of the flowing cryogen having a high cooling potential. First and second mass flow rates of the gaseous and liquid forms of the flowing cryogen are produced. The first and second mass flow rates are combined into a two phase flow containing the gaseous and liquid forms of the cryogen and the flowing cryogen is delivered as the two phase flow. The cooling potential of the cryogen as delivered is regulated by increasing the amount of the gaseous form of the flowing cryogen contained in the two phase flow to decrease its cooling potential and alternately, by increasing the amount of the liquid form of the flowing cryogen contained in the two phase flow to increase its cooling potential.

BRIEF DESCRIPTION OF THE DRAWINGS

While the specification concludes with claims particularly pointing out the subject matter that Applicants regard as their invention, it is believed that the invention will be better understood from the following description taken in conjunction with the accompanying drawings in which:

DETAILED DESCRIPTION

Figures 1, 2, 3:
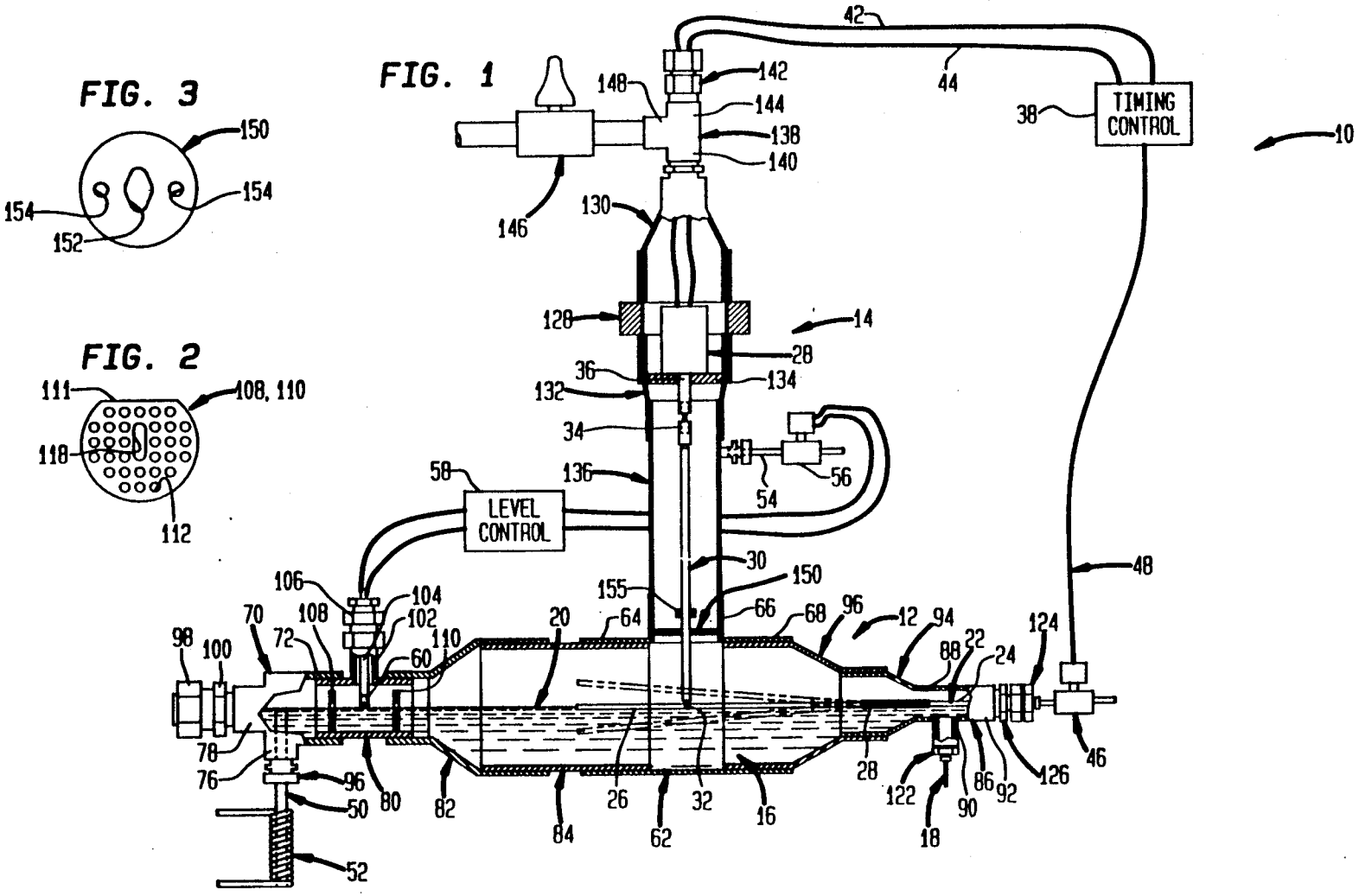
FIG. 1 is an elevational view of a cryogen delivery apparatus in accordance with the present invention with portions broken away.
FIG. 2 is a plan view of a baffle plate used in the apparatus shown in FIG. 1.
FIG. 3 is a plan view of a guide plate used in the apparatus shown in FIG. 1.

With reference to FIGS. 1–3, a preferred embodiment of a cryogen delivery apparatus 10 is illustrated. Although not illustrated, apparatus 10, when in use, is preferably insulated with vacuum jacketing or expanded foam. Most preferably, apparatus 10 is encapsulated in foam insulation.

Apparatus 10 is a pressure vessel having a cryogen receiving/delivering portion 12 connected to a tower portion 14 in a "T"-like configuration. A cryogen 16 is received within cryogen receiving/delivery portion 12 through an inlet conduit 18. Although, as indicated above, apparatus 10 is used in an insulated environment, ambient heat, albeit at a low heat transfer rate, causes cryogen 16 to boil off into a liquid and a gaseous phase separated by a liquid-gas interface designated by reference numeral 20. Moreover, the quality of cryogen 16 as received from inlet conduit 18 is arbitrary, and thus, cryogen 16 tends to separate into the liquid and gaseous phases within cryogen receiving/delivery portion 12. As will be discussed, liquid-vapor interface 20 is preferably maintained at the level of the central axis of cryogen receiving/delivery portion 12.

The cryogen is delivered from apparatus 10 through an outlet conduit 22 having an outlet section 24 and a moveable end section 26, movable above and below liquid-gas interface 20. Movable end section 26 is connected to outlet section 24 by a flexible central section 28 preferably formed by an extruded steel bellows. In the illustrated preferred embodiment, the extruded steel bellows comprises a 0.64 cm. stainless steel flexible tubing manufactured by CAJON Co. of 9760 Shepard Road, Macedonia, Ohio 44056.

When moveable end section 26 is raised above liquid-gas interface 20 into the gaseous phase of cryogen 16, a first mass flow rate of a pure gaseous form of cryogen 16 is delivered from outlet conduit 22; and when moveable end section 26 is lowered below liquid-gas interface 20 into the liquid phase of cryogen 16, a second mass flow rate of a pure liquid form of cryogen 16 is delivered from outlet conduit 22. As may be appreciated, the time intervals in which moveable end section 26 is above and below liquid-gas interface 20 will determine the amount of the pure liquid and gaseous forms of cryogen 16 that are delivered from cryogen delivery apparatus 10.

Thus, cryogen delivery apparatus 10 can be used to repeatedly deliver measured amounts of either the pure gaseous and liquid forms of cryogen 16 by regulating the durations of the time intervals in which moveable end section 26 is above and below liquid vapor interface 20. As will be discussed hereinafter, cryogen delivery apparatus 10 has further utility.

Cryogen 16 has a cooling potential, that is, the potential to adsorb heat from an article to be cooled. It is to be noted that a mass of the liquid form of cryogen 16 has a higher cooling potential than the gaseous form of cryogen 16 because of its latent heat of vaporization. Therefore, cryogen delivery apparatus 10 can also function to alternately deliver cryogen 16 with a low cooling potential by delivering cryogen 16 in its pure gaseous form and to deliver cryogen 16 with a high cooling potential by delivering cryogen 16 in its pure liquid form.

Cryogen delivery apparatus 10 can further function to deliver cryogen 16 with a cooling potential anywhere between the low and high cooling potentials of the pure gaseous and the liquid forms of cryogen 16. This is accomplished by oscillating moveable end section 26 above and below liquid-vapor interface 20. Such oscillating motion of moveable end section 26 combines the first and second mass flow rates within outlet conduit 22 into a two phase flow so that cryogen 16 is delivered from the pressure vessel as the two phase flow. The two phase flow has a cooling potential that is proportional to the average amounts of the gaseous and liquid forms of cryogen 16 contained therein. For example, the greater the average amount of the gaseous form of cryogen 16 contained within the two phase flow, the lower the cooling potential of cryogen 16 delivered from the pressure vessel; and the greater the average amount of the liquid form of cryogen 16 contained within the two phase flow, the greater the cooling potential of cryogen 16 delivered from the pressure vessel.

The average amounts of the gaseous and liquid forms of cryogen 16 contained within the two phase flow can be regulated by regulating the durations of the time intervals that moveable end section 26 is above and below liquid-vapor interface on a periodic basis. The period of each oscillation can be said to comprise a sum of a first time interval during which moveable end section 26 is above liquid-vapor interface 20 and a second time interval during which moveable end section 26 is below liquid-vapor interface 20. The average amounts of the gaseous and liquid forms of cryogen 16 contained in the two phase flow will be proportional to the durations of the first and second time intervals. For instance, an increase in the first time interval and thus, a decrease in the second time interval, will increase the average amount of the gaseous form of cryogen 16 present in the two phase flow and decrease the average amount of the liquid form of cryogen 16 present in the two phase flow and vice-versa. Therefore, selected individual regulation of the first and second time intervals will also regulate the cooling potential of cryogen 16 delivered from the pressure vessel anywhere between the low and high cooling potentials of the gaseous and liquid forms of cryogen 16.

The sum of the first and second time intervals will typicably be less than about 1.0 seconds in order to insure uniform two phase flow. However, as may be appreciated, the magnitude of the sum of first and second time intervals will depend somewhat on the cooling requirements involved in the particular application of apparatus 10.

Moveable end section 26 is moved or oscillated by a solenoid 28 acting through a rod 30 connected, at one end, by a wire loop 32 to moveable end section 26 and at the other end by a rod end 34 to an actuating arm 36 of solenoid 28. It should be mentioned that solenoid 28 is preferably an open frame AC solenoid manufactured by LUCAS LEDEX Inc. of 801 Scholz Drive, Vandalia, Ohio 45377. Rod end 34, which may be obtained from a variety of manufacturers, is a particularly preferred component of apparatus 10 to allow some degree of imprecision in its manufacture.

Means, preferably in the form of a timing control circuit 38, is connected to solenoid 28 by lead-in wires 42 and 44. Timing control circuit 38 is one of many well known circuits that permit time intervals to be preset and are capable of activating solenoid 28, by electrical impulse, to lower or raise moveable end section 26 for the duration of such preset time intervals. As may be appreciated, if for instance, timing control circuit 38 is set to lower or raise moveable end section 26 in equal time intervals, equal amounts of the selected form of cryogen 16 will be repeatedly delivered from apparatus 10.

It should be mentioned that the exact form of timing control circuit 38 would depend upon the requirements of the particular application for cryogen delivery apparatus 10. In this regard, timing control circuit 38 could be either a digital or analog device. For relatively simple applications in which cryogen 16 is only to be delivered as a two phase flow or alternatively only in either of its gaseous or liquid forms, timing control circuit 38 might be an analog device having one set of inputs for either registering periodic first and second time intervals or two non-periodic time intervals. Increasingly complex application requirements would require timing control circuit 38 to have an increasingly sophisticated capability and thus, a greater number of inputs.

Figure 4:
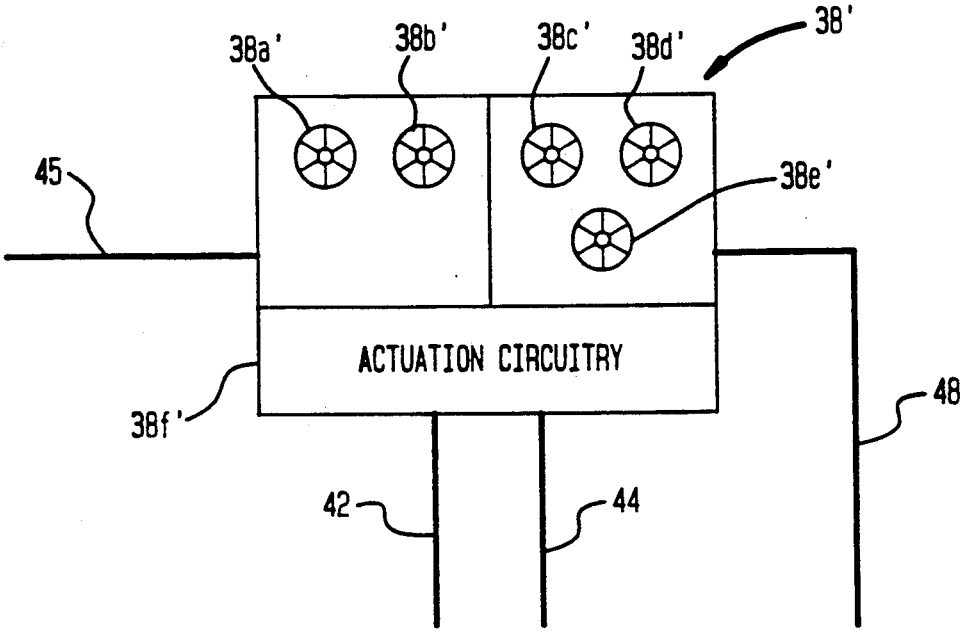
FIG. 4 is a schematic illustration of a controller used in the cryogen delivery apparatus illustrated in FIG. 1.

With reference to FIG. 4, a schematic of a controller 38' is illustrated. Controller 38', either a digital or analog device, is a form of timing control circuit 38 that is equally well suited to be used in metering applications and controlled cooling potential applications for apparatus 10. Controller 38' is provided with inputs **38*a'*, 38*b'*, 38*c'*, and 38*d'* for registering two non-periodic time intervals and one set of periodic first and second time intervals. An input 38*e'* is provided for registering a time interval for controlling the duration that the two phase flow form of cryogen 16 is delivered as per the first and second time intervals set in inputs 38*c'* and 38*d'*. Inputs 38*a'*–38*e'* can be dials, thumb wheels in an analog device or a set of coded instructions in a digital device. Actuation circuitry 38*f'* responsive to the registered time intervals is provided for actuating solenoid 28 to raise and lower moveable end section 26 for the duration of such time intervals. Actuation circuitry in a digital device may be an I/O port connected to a power source for providing an electrical impulse to solenoid 28. In an analog circuit, actuation circuitry 38*f'* can be a relay connected to the power source. Controller 38' can be remotely initiated by an electrical impulse supplied by a lead 45 such that cryogen 16 will be repeatedly delivered in accordance with the time intervals registered in inputs 39*a'* through 39*e'*** upon such remote initiation.

A non periodic time interval set in input **38*a'* causes moveable end section 26 to be moved above liquid-vapor interface 20 and the gaseous form of cryogen 16 with a low cooling potential to be delivered; a non periodic time interval set in input 38*b'* causes moveable end section 26 to be lowered below liquid-vapor interface 20 and the liquid form of cryogen 16 with the high cooling potential to be delivered; and a set of periodic first and second time intervals set in inputs 38*c'* and 38*d'* causes moveable end section 36 to oscillate and cryogen 16 to be delivered as the two phase flow with a cooling potential proportional to the ratio of the first and second time intervals and for the duration of the time interval set in input 38*e'*. Timing control circuit 38' operates such that if time intervals are set in all inputs 38*a'* through 38*e'*, the gaseous form of cryogen 16 will first be delivered followed by the liquid and two phase flow forms of cryogen 16**.

It is to be noted that cryogenic delivery apparatus 10 when functioning to deliver cryogen 16 as the two phase flow incorporates a method of the present invention. In accordance with this method, cryogen 16 flowing into the pressure vessel is separated into liquid and gaseous phases of cryogen 16 containing gaseous and liquid forms of cryogen 16 with low and high cooling potentials. First and second mass flow rates of cryogen 16 are produced by raising and lowering moveable section 26. The first and second mass flow rates are then combined into the two phase flow by oscillating moveable section above and below liquid-vapor interface 20 to deliver cryogen 16 from outlet conduit 22 as the two phase flow. The cooling potential of the cryogen is regulated by regulating the average amounts of the pure liquid and gaseous forms of the cryogen 16 as delivered. In cryogen delivery apparatus 10, this is accomplished by regulating the durations of the first and second time intervals.

In order to incorporate cryogenic delivery apparatus 10 into a plastic injection blow molding production line, inlet line 18 of apparatus 10 would be connected to a liquid nitrogen supply tank to supply flowing liquid nitrogen to the pressure vessel. Outlet conduit 22 would be connected to a line leading to the blowing pin. It is to be noted that the blowing pin may be provided with a coaxial tube within the bore of the blowing pin to inject the nitrogen into the mold. Air used in blowing the mold passes through an annular space between the coaxial tube and the inner surface of the bore of the blowing pin. Lead 45 of controller 38' would be connected to control circuitry of the plastic injection blow molding equipment in a manner well known in the art to synchronize the initiation of controller 38' with the molding process being effectuated by such molding equipment.

The first and second time intervals are determined by experimentation For example, in the blow molding of large objects, a non-periodic time interval is first set into input 38*b'* of timing control circuit 38 so that moveable end section 36 is below liquid-vapor interface 20. As such, cryogen 16 is delivered to the molded plastic part in liquid form. The time is noted before which the liquid first starts to pool in the bottom of the molded plastic part. Thereafter, another long non-periodic time internal is set into input 38*a'* of controller 38' so that moveable end section 26 is above liquid-vapor interface 20 to complete cooling of the molded plastic part with the pure gaseous form of cryogen 16. The time is then noted at which cooling of the molded plastic part is complete. Thereafter, subsequent trials are completed to decrease the cooling time by delivering cryogen 16 as a two phase flow in place of the gaseous form of cryogen 16. This is accomplished by oscillating moveable end section 26 so that an increasing proportion of cryogen 16 is delivered is in its pure liquid form. In other words, successive runs are undertaken with steadily increasing second time intervals set in input 38*d'* and decreasing first time intervals set in input 38*c'* to increase the cooling potential of the cryogen. The cooling potential of the cryogen is increased until cryogen 16 again pools in the bottom of the molded plastic part. At this point, the first and second time intervals making up each period of oscillation are noted as well as the time before which cryogen 16 again pooled.

Before operation of the plastic injection blow molding equipment, controller 38' is set with a non-periodic time interval of 0.0 in input 39*a'*. Input 38*b'* is set for the duration of the non-periodic time interval, experimentally determined above, before which the liquid form of cryogen 16 first started to pool in the mold. Inputs 38*c'* and 38*d'* of controller 38' are set at the first and second experimentally determined time intervals and input 39*e'* is set at the time interval before which the liquid form of cryogen 16 again began to pool. Thus, each time the molded article is to be cooled, controller 38' will control moveable section 36 in accordance with the set time intervals. The end result is that the total time necessary to cool the mold is reduced so that the production line can function with a greater output and with no wastage of cryogen.

The present invention could be utilized in an injection blow molding technique, described above, in which gaseous nitrogen is delivered through a blowing pin to expand the parison to fit the mold; and thereafter, liquid nitrogen is delivered through the blowing pin to cool the expanded parison. In accordance with the present invention, the inlet or cryogen delivery apparatus 10 would be connected to a source of liquid nitrogen at a suitable pressure. Outlet conduit 28 would be connected to the blowing pin. Input 39*a'* of timing control circuit 38' would be set for a non-periodic time interval in which moveable end section 26 were moved into a position above liquid-vapor interface 20 and the pure gaseous form of the nitrogen would be delivered to expand the parison It is important to note that the gaseous form of nitrogen with its low cooling potential is used in expanding the parison to prevent the freezing of the parison that would otherwise occur if nitrogen with a higher cooling potential were used. Thereafter, time interval, to be set into timing control circuit 38' for cooling the molded plastic part would be experimentally determined as described above.

It should be noted that the cooling states noted above represent only one of a variety of techniques for utilizing the control of cooling potential afforded by the present invention. For example, very small parts could benefit most through a single stage of two phase flow cooling to afford the optimum cooling time and uniformity. Conversely, very large parts could warrant continuous variation of the cryogen cooling potential (rather than two distinct steps) to achieve optimum cooling performance. Also, unusually shaped parts where it is difficult to uniformly cool with a cryogen spray would benefit from cooling with a set two phase flow cooling rather than pure liquid cooling.

Although not illustrated, inlet line 18 could be provided with a throttle valve. The throttle valve could be preset to control the flow rate of cryogen 16 in inlet line 18. Such inlet line throttling would result in an adjustment of the first and second mass flow rates of the gaseous and liquid forms of cryogen 16 flowing through outlet conduit 22 in equal amounts. Additionally, outlet conduit 22, within outlet section 24 thereof, could also be provided with a throttling valve. Such a throttle valve would simultaneously adjust the first and second mass flow rates of the gaseous and liquid forms of cryogen flowing through outlet conduit 22 in a proportion approximately equal to the ratio of the square root of their mass densities. The simultaneous adjustment of the inlet line throttling valve and the outlet conduit throttling valve would allow an adjustment in the flow rates of either of the liquid or gaseous forms of cryogen 16 within the range discussed above. It is to be appreciated that any other head losses upstream or downstream of apparatus 10 will have a contributing effect and must be taken into account in performing such mass flow rate adjustment.

A solenoid operated but-off valve 46, also connected to timing control circuit 38 by an electrical connection 48, is preferably provided in outlet section 24 to allow the gaseous flow of cryogen to be cut off in those applications of apparatus 10 in which only measured amounts of the liquid form of cryogen 16 is to be delivered or, to limit the amount of the gas form of cryogen 16 that is to be delivered even if both the gas and liquid forms of cryogen 16 are to be utilized in a particular process. When timing control circuit 38 activates solenoid 28 to raise moveable end section 26 into the gaseous phase of cryogen 16, timing control circuit also closes cut-off valve 46. In this regard, in an application in which only the liquid form of cryogen 16 is to be delivered, timing control circuit 38 closes cut-off valve 46 with a slight time delay to purge the liquid form of cryogen 16 from outlet conduit 22. In such application, cut-off valve 46 if being used to limit the loss of cryogen 16. In an application in which a measured amount of the gas of cryogen 16 that is to be delivered, timing control circuit 38 can be set with a time delay to close cut-off valve 46 in accordance with the amount of the gas form of cryogen 16 that is to be delivered. In either of such applications, cut-off valve 46 is only being utilized to cut-off the flow of the gas form of cryogen 16; and may be inexpensively fabricated in accordance with less stringent positive cut-off requirements for a valve that is to be cut off the gas flow of a cryogen over one that is required to cut off the liquid flow of a cryogen. Although not illustrated, a single-pole, single-throw switch could be provided in electrical connection 48 to disable the operating mode of apparatus 10 in which only the liquid form of cryogen 16 is to be delivered.

Controller 38' has a default state that is initiated after the end of the last time interval set in inputs 38a', 38b' and 38e'. In the default state, solenoid 28 is activated to raise moveable end section 26 and, thereafter, with a slight time delay, cut-off valve 40 is activated to close. The slight time delay purges any liquid remaining in outlet conduit 22; and the closure of cut-off valve 46 conserves cryogen 16 by preventing the pure gaseous form of cryogen 16 from escaping through outlet conduit 22.

Liquid-gas interface 20 is maintained at the level of the central axis of cryogen receiving/delivery portion 12 by an overflow tube 50 which is open at its top end (within cryogen receiving/delivery portion 12) and closed at its lower end (below cryogen receiving/delivery portion 12). A tube 52, in which room temperature dry air or nitrogen circulates, is coiled about the lower end of overflow tube 50. As the level of the liquid phase of cryogen 16 rises above the open top end of overflow tube 50, it flows into overflow tube 50 and is heated by tube 52. After heating, the liquid form of the cryogen vaporizes to increase the amount of the gaseous form of the cryogen contained within cryogen receiving/delivery portion 12. As may be appreciated, the lower end of overflow tube 50 could be provided with an electrical heater or an arrangement of fins to function in place of tube 52 for heating the lower end of overflow tube 50.

Figure 5:
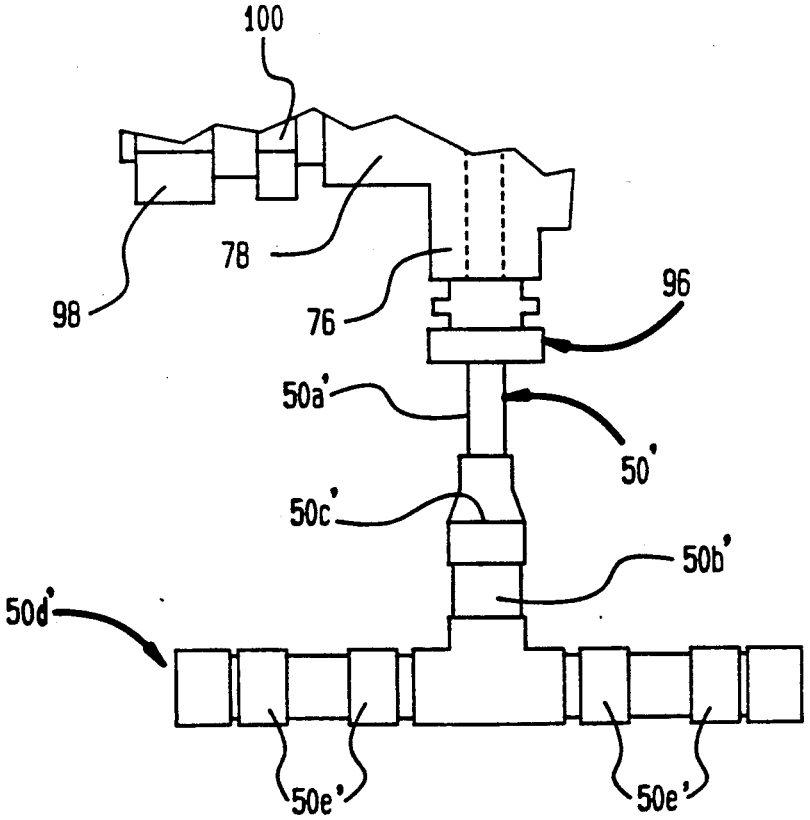
FIG. 5 is an enlarged fragmentary view of a cryogen delivery apparatus of the present invention incorporating a particularly preferred embodiment of an overflow tube in accordance with the present invention.

With reference now to FIG. 5, in a particularly preferred embodiment, an electrically heated overflow tube 50' is provided to function in place of overflow tube 50, described above. Overflow tube 50' has a narrow portion 50a' projecting into cryogen receiving-/delivery portion 12 and a wide portion 50b' connected to narrow portion 50a' by a reduction fitting 50c'. A horizontal tube 50d' is connected to the bottom of wide portion 50b' and is provided with four electrical heaters 50e'. Although not illustrated, electrical heaters 50e' arewired to an electrical power source. The liquid form of cryogen 16 flowing into overflow tube 50' is vaporized by electrical heaters 50e' to add to the gaseous form of cryogen 16 contained within cryogen receiving-/deliver portion 12.

In order to permit access to electrical heaters 50e', narrow portion 50a' will project from the insulation. The small internal diameter of narrow portion 50a' is preferred to prevent convection within overflow tube 50'. However, due to the possibility of boiling at the wall of overflow tube 50 after it exits the insulation shell, a vapor block can occur to prevent liquid from dropping down to heated horizontal tube 50d'. Vapor blocks are prevented by the provision of wide portion 50b which acts to limit the possible wall boiling. Wide portion 50b should have an internal area that is greater than that of narrow portion 50a by a factor of about 4.0.

The level of the gas phase of cryogen 16 is maintained by venting the gaseous form of cryogen 16 through a vent line 54 connected to tower portion 14. The venting is controlled by a solenoid operated cut-off valve 56 in vent line 54 which is activated to open by a level control circuit 58, preferably a liquid level control manufactured by KAY-RAY/SENSALL Inc. of 523 Townline Road, Suite 4, Hauppauge, N.Y. 11788. When the level of the liquid phase of cryogen 16 falls below the central axis of cryogen receiving/delivery portion 12, a liquid level sensor 60, preferably an ultrasonic level sensor, also manufactured by KAY-RAY/SENSALL Inc, causes level control circuit 58 to activate cut-off valve 56 to open and vent the excess gaseous form of cryogen 16. For system stability purposes, there should be a slight overlap between the height of the top end of overflow tube 50 above the central axis of cryogen receiving/delivery portion 12 and the level of liquid below the central axis of cryogen receiving/delivery portion 12, at which cut-off value 56 is activated. As mentioned above, cryogen 16, when in inlet line 18, may be of arbitrary quality, but preferably no less than 50%. As the quality of cryogen 16 falls, more vapor will be vented through vent line 54 to maintain the level of cryogen 16. As the quality of cryogen 16 rises, more liquid will be vaporized in overflow tube 50 to maintain the level of cryogen 16.

Cryogen receiving/delivery portion 12 and tower portion 14 are preferably fabricated from conventional copper plumbing fittings. The size of the fittings and therefore, the volume of portions 12 and 14 may be selected in accordance with the cryogen/delivery requirements for the intended application of apparatus 10.

As illustrated, cryogen receiving/delivery portion 12 includes a central "T" fitting 62 having legs 64, 66 and 68. At the illustrated left side of portion 12, a reducing "T" fitting 70, having legs 72, 76, and 78 is connected, at leg 72 and by a pipe 80, to a reduction fitting 82 which is in turn connected by a pipe 84 to leg 64 of "T" fitting 62. At the illustrated right side of portion 12, a reducing "T" fitting 86 having legs 88, 90 and 92, is connected, at leg 88, to a reduction fitting 94 which in in turn connected by a reduction fitting 96 to leg 68 of "T" fitting 62.

Overflow tube 50 is connected to leg 76 of reducing "T" fitting 70 by a pressure coupling 96. An end plug 98 is threadably secured to a threaded coupling 100 which is connected to leg 78 of reducing "T" fitting 70.

A pipe 102 is connected, at right angles, to pipe 80 for mounting level sensor 60 within cryogen receiving-/delivery portion 12. Level sensor 60 is threaded onto the lower end of a tube 104, which is connected to the top end of pipe 102 by a compression fitting 106.

With specific reference to FIG. 2, baffle plates 108 and 110 are connected within pipe 80 on opposite sides of level sensor 60 to prevent unnecessary venting of the gaseous form of cryogen 16 from vent line 54 by preventing splashes of the liquid form of cryogen 16 from producing an erroneous, low height indication of gas-vapor interface 20. Such splashes may be produced by the rapid expansion of liquid cryogen 16 within overflow tube 50 or by wave motion of the liquid cryogen caused by the raising and lowering of moveable end section 26 of outlet conduit 22. In this regard, each of the baffle plates 108 and 110 is of disc-like configuration with a top section removed to form a top edge 111 spaced below the inside of cryogen receiving/delivery portion 12 for the free passage of the gaseous form of cryogen 16; and each has a plurality of apertures 112 to permit passage of the liquid form of cryogen 16 at a reduced flow rate. Thus, baffle plates 108 and 110 act as barriers; with baffle plate 108 acting as a barrier to splashes from airflow tube 50 and baffle plate 110 acting as a barrier to splashes from the raising and lowering of moveable end section 26. Both Baffle plates 108 and 110 are provided with central, elongated or oval apertures 118 for purposes that will be discussed hereinafter.

Inlet conduit 18 is connected to leg 90 of reducing "T" fitting 86 by a pressure coupling 122. Outlet section 24 of outlet conduit 22 is connected to pressure coupling 124 which is in turn connected by a pressure coupling 126 to leg 92 of reducing "T" fitting 86. Pressure coupling 124 may be removed to remove outlet conduit 22 from cryogen receiving/delivery portion 12. Upon replacement of outlet conduit 22, end plug 98 is removed and a rod, not illustrated, may be extended through apertures 118 of baffle plates 108 and 110 to help in manipulating moveable end section 24 to extend into wire loop 32 of rod 30.

Tower portion 14 includes a pipe union 128 which joins a pair of upper and lower reduction fittings 130 and 132. Lower reduction fitting 130 is provided with a mounting plate 134 for mounting solenoid 28 and is connected to leg 66 of "T" fitting 62 by a pipe 136. Preferably pipe 136 is sized so that solenoid 28 is approximately 15.24 cm. above liquid-gas interface 20 to prevent freeze-up of solenoid 28. A "T" fitting 138 is connected at a leg 140 thereof to upper reduction fitting 130; and a wire lead in 142, connected to a leg 144 of "T" fitting 138, is provided for entry of wires into tower portion 14 A pressure relief valve 146, connected to a leg 148 of "T" fitting 138, is provided to prevent over pressures from destroying either tower portion 14 or cryogen receiving/delivery portion 12.

With specific reference now to FIG. 3 an annular guide plate 150 is provided within the lower end of pipe 136 to serve as a guide for rod 30. To this end, guide plate 150 has a central aperture 152 through which rod 30 extends, and a pair of outlying apertures 154 for passage of the gaseous form of cryogen 16 into tower portion 14. Additionally, a collar 155 may be connected to rod 30 to limit the downward movement of moveable end section 26 of outlet conduit 22 by contacting guide plate 150.

Although preferred embodiments have been shown and described in detail it will be readily understood and appreciated by those skilled in the art that numerous omissions, changes, and additions may be made without departing from the spirit and scope of the invention.

We claim:

1. A cryogen delivery apparatus for regulating the cooling potential of a flowing cryogen, said cryogen delivery apparatus comprising:

a pressure vessel having an inlet for receiving the flowing cryogen within the pressure vessel;

means for maintaining the flowing cryogen within the pressure vessel so that a liquid-vapor interface is produced within the pressure vessel with a gaseous form of the cryogen having a low cooling potential situated above the liquid-vapor interface and a liquid form of the cryogen having a high cooling potential situated below the liquid-vapor interface;

conduit means extending into the pressure vessel for delivering the flowing cryogen from the pressure vessel as a two phase flow, the conduit means having a moveable section adapted to move above and below the liquid-vapor interface to form, within the conduit means, a first mass flow rate of the gaseous form of the flowing cryogen and a second mass flow rate of the liquid form of the flowing cryogen;

actuable movement means adapted to move the moveable section above and below the liquid-vapor interface in an oscillating motion for combining the first and second mass flow rates within the conduit means and thereby forming the two phase flow;

the oscillating motion having a period defined by a sum of first and second time intervals during which the moveable section is above and below the liquid-vapor interface, respectively, and the two phase flow containing the gaseous and liquid forms of the flowing cryogen in average amounts proportional to the first and second time intervals; and a controller having registration means for registering at least one set of the first and second time intervals and actuation means responsive to the registration means for actuating the actuable movement means to move the moveable section in the oscillating motion and at the period, whereby increasing the first time interval increases the average amount of the gaseous form of the flowing cryogen contained in the two phase flow and alternately, increasing the second time interval increases the average amount of the liquid form of the flowing cryogen contained in the two phase flow to alternately decrease and increase and thus, regulate the cooling potential of the flowing cryogen as delivered.

2. The apparatus of claim 1, wherein:

the conduit means comprises, a pipe having an outlet section extending into the pressure vessel, a moveable end section located within the pressure vessel to form the moveable section of the conduit means, and a flexible central section connecting the moveable end section to the outlet section; and the actuation means is connected to the moveable end section of the pipe.

3. The apparatus of claim 2, wherein the flexible central section comprises an extruded steel bellows

4. The apparatus of claim 2, wherein the actuable movement means comprises:

a solenoid having an actuating arm; and rod means for connecting the actuating arm to the moveable end section of the pipe.

5. The apparatus of claim 4, wherein the pressure vessel comprises:

a horizontal cryogen receiving/delivery portion within which the liquid-vapor interface is maintained and the pipe extends; and a vertical tower portion connected to the cryogen receiving/delivery portion in a "T"-like configuration and housing the solenoid at a pre-selected height above the liquid form of the cryogen sufficient to prevent freeze-up of the solenoid.

6. The apparatus of claim 1, wherein the liquid-vapor interface maintaining means comprises:

a vent line connected to the pressure vessel and having an automatically actuated in line cut-off valve;

a level detector, located within the pressure vessel to sense the height of the liquid form of the flowing cryogen within the pressure vessel;

level control means connected to the level detector and the cut-off valve for automatically opening the cut-off valve when the level of the liquid form of the cryogen falls below a predetermined height;

an overflow tube projecting into the pressure vessel so that one end thereof is essentially at the level of the predetermined height; and heating means connected to the other of the ends of the overflow tube and outside of the pressure vessel such that when the level of the liquid form of the flowing cryogen is above the predetermined level, it flows into the overflow tube and is heated by the heating means and thereby vaporized to add to the gaseous form of the flowing cryogen within in the pressure vessel.

7. A method for regulating the cooling potential of a flowing cryogen comprising:

separating the flowing cryogen into liquid and gaseous phases containing a gaseous form of the cryogen having a low cooling potential and a liquid form of the cryogen having a high cooling potential;

producing a first mass flow rate of the gaseous form of the cryogen and a second mass flow rate of the liquid form of the cryogen;

combining the first and second mass flow rates into a two phase flow containing the liquid and gaseous forms of the cryogen;

delivering the cryogen as the two phase flow; and regulating the cooling potential of the of the cryogen as delivered by increasing the amount of the gaseous form of the flowing cryogen contained in the two phase flow to decrease its cooling potentional and alternately, by increasing the amount of the liquid form of the flowing cryogen contained in the two phase flow to increase its cooling potential.

8. The method of claim 7, wherein the cryogen is separated into the liquid and gaseous phases by receiving the cryogen within a pressure vessel and maintaining the cryogen within the pressure vessel so that a liquid vapor interface forms within the pressure vessel with the gaseous form of the cryogen situated above the liquid-vapor interface and the liquid form of the cryogen situated below the liquid-vapor interface.

9. The method of claim 8, wherein:

the cryogen is delivered from the pressure vessel as the two phase flow through a conduit having a moveable end section located within the pressure vessel and adapted to move above and below the liquid-vapor interface;

the first and second mass flow rates are produced by raising and lowering the moveable end section above and below the liquid-vapor interface, respectively;

the first and second mass flow rates are combined to produce the two phase flow by oscillating the moveable end section above and below the liquid-vapor interface at a period defined by a sum of first and second time intervals in which the moveable end section is above and below the liquid-vapor interface, respectively;

the average amounts of the pure liquid and gaseous forms of the cryogen present in the cryogen as delivered are respectively proportional to the durations of the first and second time intervals; and the cooling potential of the cryogen as delivered is decreased by increasing the first time interval and increased by increasing the second time interval.

* * * * *